United States Patent [19]

Amin et al.

[11] Patent Number: 4,474,035

[45] Date of Patent: Oct. 2, 1984

[54] DOMED ACCUMULATOR FOR AUTOMOTIVE AIR CONDITIONING SYSTEM

[75] Inventors: Jayendra J. Amin, Canton; Brian R. Kelm, Northville; Robert H. Bean, Birmingham, all of Mich.

[73] Assignee: Ford Motor Company, Dearborn, Mich.

[21] Appl. No.: 564,792

[22] Filed: Dec. 23, 1983

[51] Int. Cl.[3] ..... F25B 43/00

[52] U.S. Cl. ..... 62/503; 55/192; 55/391; 55/463

[58] Field of Search ..... 62/503; 55/462, 463, 55/192, 391

[56] References Cited

U.S. PATENT DOCUMENTS

| | | | |
|---|---|---|---|
| 3,212,289 | 10/1965 | Bottum | 62/503 |
| 3,778,984 | 12/1973 | Lawser | 55/333 |
| 4,111,005 | 9/1978 | Livesay | 62/503 |
| 4,182,136 | 1/1980 | Morse | 62/503 |
| 4,270,934 | 6/1981 | Widdowson et al. | 55/316 |

*Primary Examiner*—Ronald C. Capossela

*Attorney, Agent, or Firm*—Donald J. Harrington; Keith L. Zerschling

[57] ABSTRACT

An accumulator for an air conditioning system having a compressor, a condenser and an evaporator wherein the accumulator receives refrigerant from the evaporator at a location near an upper wall thereof, said accumulator including a domed baffle plate in its interior adjacent the accumulator inlet opening whereby liquid portions of the refrigerant are dispersed to the sides of the accumulator allowing the gaseous components of the refrigerant to accumulate in the upper regions of the accumulator adjacent the inlet opening of an outlet tube that extends vertically through the accumulator.

2 Claims, 4 Drawing Figures

DOMED ACCUMULATOR FOR AUTOMOTIVE AIR CONDITIONING SYSTEM

GENERAL DESCRIPTION OF THE INVENTION

Our invention comprises an improved refrigerant accumulator for an air conditioning system in an automobile vehicle. Such systems use Freon as a refrigerant. An air conditioning compressor in the system compresses the Freon for delivery to an air conditioning condenser where the state of the refrigerant changes from gas to liquid. The outlet side of the condenser is connected to an expansion valve and to an evaporator where the refrigerant changes state from a liquid to a gas. An air blower circulates air over the evaporator to the vehicle passenger compartment causing heat transfer to occur from the ambient air to the evaporator.

The outlet side of the evaporator in a typical air conditioning system installation is connected to an accumulator that contains a liquid-gas separator. The separator causes liquid components of the refrigerant to be separated from the gaseous component before the gaseous component is returned to the compressor. The accumulator also provides for recovery of lubricating oil contained in the refrigerant gas and for returning a metered amount of lubricating oil to the inlet side of the compressor for lubrication purposes.

Since the accumulator is connected to the inlet side of the compressor, the reduced absolute pressure in the accumulator causes a portion of the liquified refrigerant to return to the gaseous state whereupon it is returned to the inlet side of the compressor. A typical example of an air conditioning system using an accumulator of this general type is shown in prior art patents Nos. 4,111,005 and 4,270,934.

Both of these patents describe accumulator devices on the suction side of the compressor. An example of an accumulator and liquid-gas separator on the high pressure side of the compressor is shown in patent No. 3,778,984, which is assigned to the assignee of the present invention. Both arrangements, regardless of whether the accumulator or separator is on the inlet side of the compressor or on the high pressure side of the compressor, function to separate liquid refrigerant from gaseous refrigerant and for separating the lubricating oil from the gas. When the accumulator or separator is located on the suction side of the compressor, however, it functions to cause a change in state of the refrigerant from liquid to gas after the liquid has been separated from the gas.

The amount of the liquid retained in the accumulator of our invention depends upon the conditions under which the system operates. But regardless of whether a large amount or a small amount of liquid is retained in the accumulator, the accumulator functions to allow only vapor to be returned to the compressor together with a very small metered amount of lubricating oil, the latter being recovered by an oil return orifice filter located at the base of the accumulator.

According to a principal feature of our invention, we have provided a domed baffle in the upper region of the accumulator; and we have strategically located the inlet for the accumulator so that the inlet flow of refrigerant to the accumulator is directed against the baffle where the refrigerant is dispersed in an efficient fashion causing liquid portions of the refrigerant to drain down the sides of the accumulator while allowing the gaseous components of the refrigerant to enter a vapor return tube, the inlet end of which is situated near the geometric center of the domed baffle. Very little turbulation in the liquid occurs as it is separated from the gaseous refrigerant component and settles to the base of the accumulator. The liquid settles at the base of the accumulator in a clear separate layer. Lubricating oil is heavier than the liquid Freon; and an oil return orifice and filter assembly, located at the base of the accumulator, picks up a controlled amount of the oil and returns it to the vapor return passage that communicates with the inlet side of the compressor thereby allowing desired lubrication of the compressor.

PARTICULAR DESCRIPTION OF THE INVENTION

Figure 1:
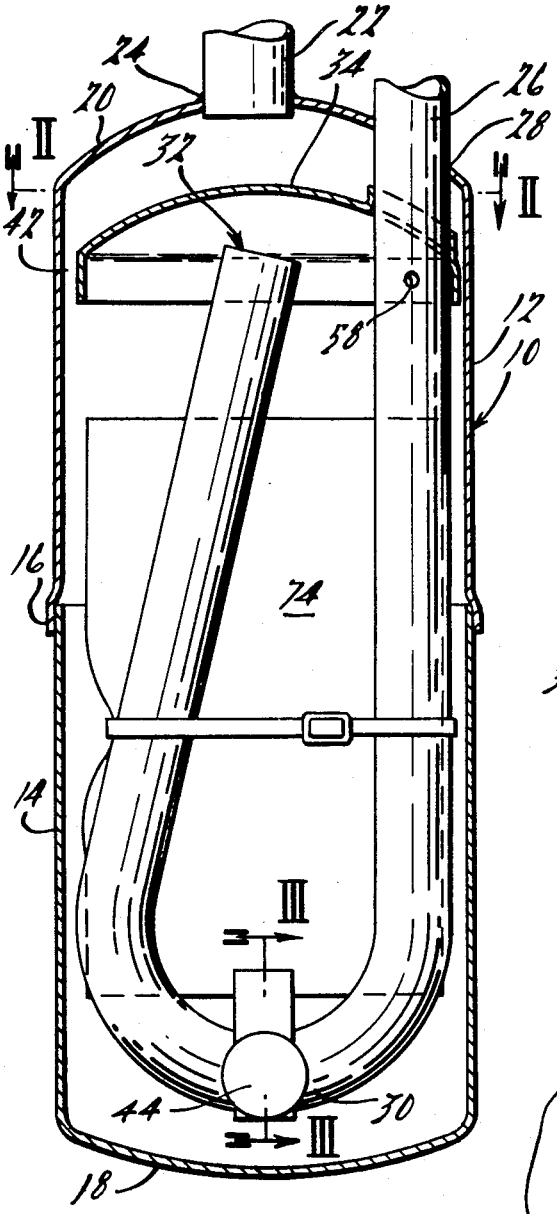
FIG. 1 is a cross-sectional assembly view of the accumulator showing the improvements of our invention.

In FIG. 1 numeral 10 designates a cylindrical housing for the accumulator. It comprises an upper portion 12 and a lower portion 14. The portions 12 and 14 are joined together in abutting relationship by means of an overlapping brazed juncture 16. The lower end of the accumulator is closed by a lower wall 18, and the upper end of the accumulator is closed by a domed upper wall 20. An inlet tube 22 is received within an opening formed in the center of the domed wall 20 and is brazed at 24 by copper hydrogen brazing. An outlet tube 26 extends through another opening in the domed wall 20 adjacent the inlet tube 22, and it too is brazed to provide a pressure seal and a permanent juncture with the wall 20 as shown at 28.

Outlet tube 26 extends vertically adjacent the inner wall of the accumulator and is curved at its lowermost portion 30, the curve portion being situated in the lowermost region in the accumulator adjacent the lower wall 18. The tube extends upwardly from the curved portion 30 to its inlet point 32. The inlet of the tube at point 32 is located within the interior of a domed baffle 34. In a preferred embodiment, the distance between the point 32 and the center of the domed baffle 34 is about 0.25 inches.

Figure 2:
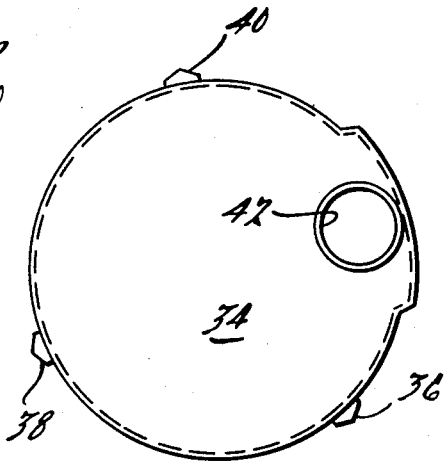
FIG. 2 is a cross-sectional view taken along the plane of section line 2—2 of FIG. 1.

Baffle 34 is shown at FIG. 2 in plan view. The margin of the baffle 34 has three locating and securing tabs 36, 38 and 40. These are spot welded to the inner wall of the cylindrical portion 12 of the accumulator. When the baffle 34 is secured in place, a space exists, as shown at 42 in FIG. 1, between the periphery of the baffle and the inner wall of the accumulator portion 12.

Baffle 34 is provided with an opening 42 through which the outlet tube 26 extends. In a preferred embodiment the top of the dome is about 0.5 inches from the upper accumulator wall 20, and the distance between point 32 and the center of the domed baffle 34 is about 0.25 inches. The circumferential clearance between the periphery of the domed baffle 34 and the inner wall of the accumulator 12 may be about 0.05 inches.

Figure 3:
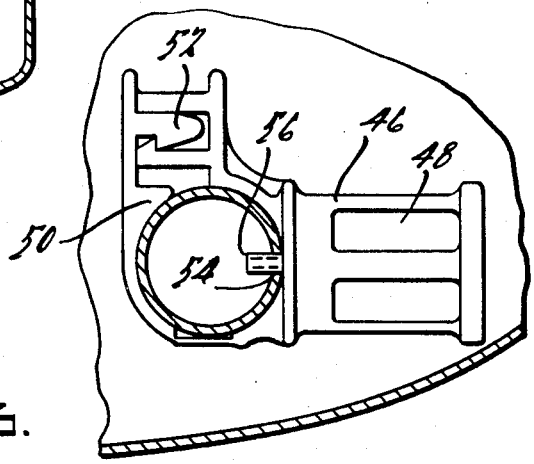
FIG. 3 is a plan view of the domed oil dispersing member of the accumulator of FIG. 1 as seen from the plane of section line 3—3 of FIG. 1.

At the base of the accumulator portion 14 there is located an oil return orifice and filter assembly 44, which is illustrated in detail in FIG. 3. It comprises a plastic housing 46 which is apertured and which includes a screen 48 within the plastic housing 46. One end of the plastic housing 46 is curved so that it surrounds outlet tube 26 as shown at 50. The portion of the housing that surrounds the outlet tube is split, and the split ends are fastened together by a fastener 52 which facilitates quick assembly.

Outlet tube 26 is provided with an opening 54 through which a metering tube 56 extends. The metering tube 56 provides communication between the interior of tube 26 and the interior of the screen filter housing 46.

Since during operation of the air conditioner system the pressure in the accumulator is higher than the pressure in the outlet tube 26, a controlled amount of oil is filtered through the orifice tube 56 so that a controlled amount of lubricating oil is returned to the gaseous circuit.

Figure 4:
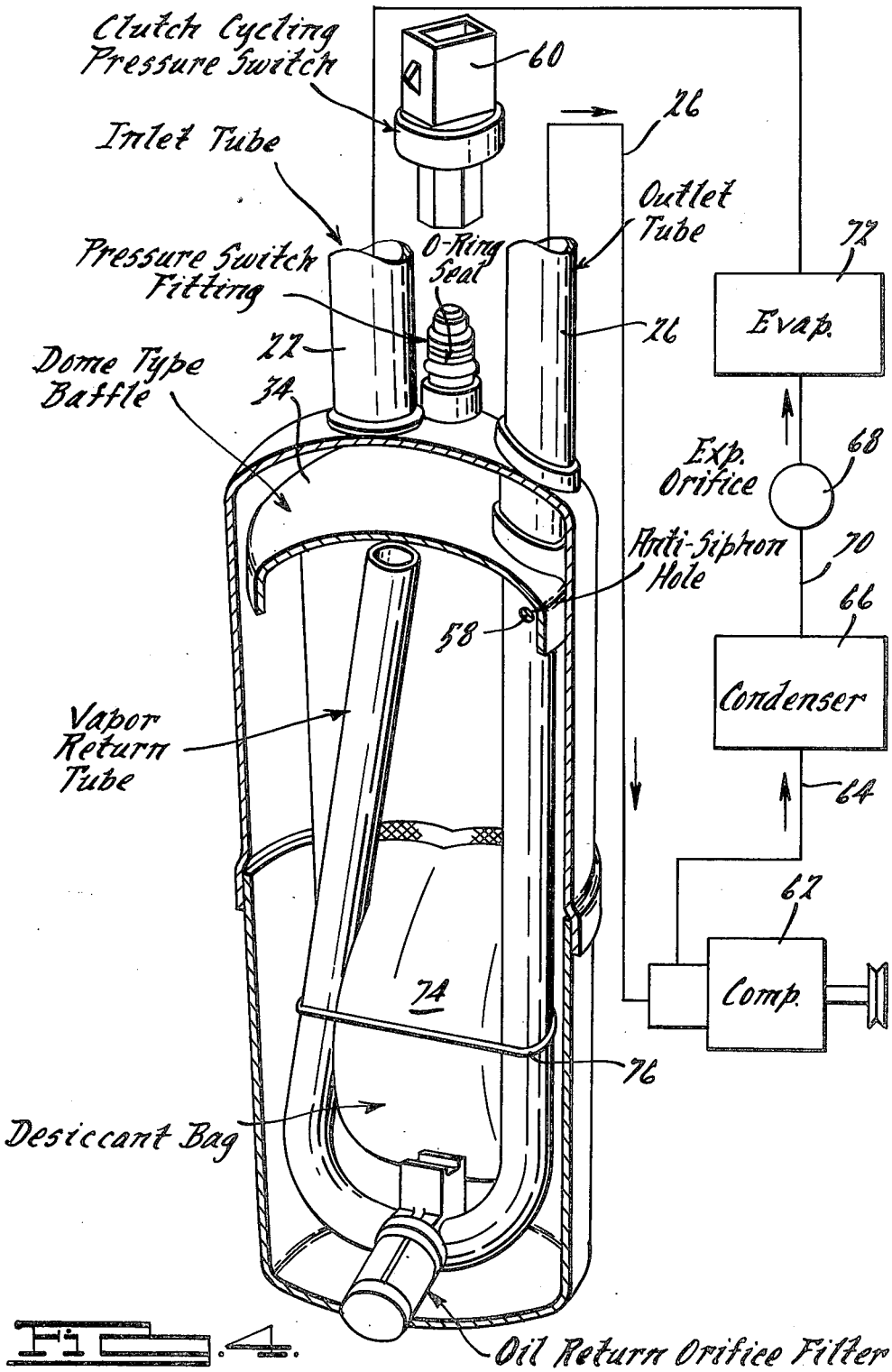
FIG. 4 is an isometric view of the accumulator assembly of FIGS. 1-3 with part of the assembly cut away to show the interior of the accumulator.

A small anti-syphon hole 58 is provided in the tube 26, as shown in FIG. 4, to prevent undesired syphoning of liquid under gravity from the interior of the accumulator to portions of the system located at a lower level than the accumulator.

A clutch cycling pressure switch assembly 60 is secured to an opening in the top wall 20 of the accumulator. It communicates with the interior of the accumulator, and it senses pressure in the accumulator. It functions as a part of the control circuit for an electromagnetic clutch that establishes and disestablishes a driving connection between an engine driven pulley and the rotor of the compressor, the latter being shown at 62 in FIG. 4. The outlet of the compressor 62 communicates through line 64 with a condenser 66 which changes the state of the compressed Freon gas to a liquid. An expansion orifice 68 is located in a line 70 connecting the condenser with the evaporator 72. The expansion orifice 68 lowers the pressure of the refrigerant and the evaporator causes the refrigerant to change its state from liquid to gas, which then is returned to the accumulator through tube 22.

Outlet tube 26 communicates with the inlet side of the compressor 62, as seen in FIG. 4.

A desiccant bag 74 is located in the accumulator and is secured to the reentrant outlet tube 26 by strap 76. This absorbs any water that may be present in the Freon gas as it passes through the system.

The domed baffle 34 more efficiently separates the liquid Freon from the gaseous component of the refrigerant in comparison to a side entry arrangement such as that shown in U.S. Pat. No. 4,270,934. The domed arrangement with the central location of the inlet tube permits a more efficient dispersion in comparison to a conical shape baffle. The improved effectiveness of the accumulator to act as a separator in turn improves the overall operating efficiency of the air conditioning system. These functional advantages are in addition to manufacturing advantages in assembling the accumulator and the improved stability of the assembly by reason of the welded construction of the domed baffle and cylindrical housing.

We claim:

1. An accumulator for use in an air conditioning system for an automotive vehicle, said system including a refrigerant circuit having a compressor, and a condenser and an evaporator arranged in series relationship on the high pressure side of the compressor:

said accumulator comprising a cylindrical housing comprised of two cylindrical portions joined together in abutting relationship to define a closed cylindrical chamber, said accumulator housing having an upper housing wall and a lower housing wall;

a baffle comprising a circular member of generally domed shape with the convex surface thereof facing the upper end wall of said accumulator in close proximity thereto;

an inlet tube extending through said upper wall at a location proximate to the geometric center of said baffle, said tube communicating with the outlet side of said evaporator;

an outlet tube extending through said upper wall of said housing adjacent the inner wall of said housing and extending through said housing substantially the entire length thereof, said outlet tube being curved at its lower extremity and extending upwardly though said housing to a point within the interior of said baffle in close proximity to the convex surface thereof;

said baffle being secured at its margin to the interior of said housing with a radial clearance between said housing and the periphery of said baffle whereby liquid components of the refrigerant passing through said accumulator to said evaporator are separated from the gaseous components thereof as the refrigerant is dispersed across the baffle, the liquid component draining downwardly under the force of gravity to the lower extremity of said accumulator as the gaseous components thereof are returned through the outlet tube to the inlet side of said compressor.

2. The combination as set forth in claim 1 wherein the inlet opening for said outlet tube is located at a point within said baffle that is higher than the periphery of said baffle whereby liquid portions of the refrigerant are returned through the outlet tube as they accumulate beneath the baffle.

* * * * *